US005484691A

United States Patent [19]

Ishida et al.

[11] Patent Number: 5,484,691

[45] Date of Patent: Jan. 16, 1996

[54] SOLID PROCESSING COMPOSITION FOR SILVER HALIDE PHOTOGRAPHIC LIGHT-SENSITIVE MATERIALS

[75] Inventors: Kenji Ishida; Takashi Deguchi, both of Hino, Japan

[73] Assignee: Konica Corporation, Tokyo, Japan

[21] Appl. No.: 290,130

[22] Filed: Aug. 15, 1994

[30] Foreign Application Priority Data

Aug. 23, 1993 [JP] Japan ..... 5-207980
Jul. 19, 1994 [JP] Japan ..... 6-167167

[51] Int. Cl.[6] ..... G03C 5/38

[52] U.S. Cl. ..... 430/458; 430/455; 430/460

[58] Field of Search ..... 430/455, 458, 430/459, 460, 453

[56] References Cited

U.S. PATENT DOCUMENTS

| | | | |
|---|---|---|---|
| 4,320,116 | 3/1982 | Björck | 424/129 |
| 4,861,582 | 8/1989 | Pollock et al. | 424/520 |
| 4,871,532 | 10/1989 | Hoogendoorn | 424/50 |
| 5,135,840 | 8/1992 | Reuter et al. | 430/458 |
| 5,185,153 | 2/1993 | Pollock | 424/440 |
| 5,270,032 | 12/1993 | Pollock et al. | 424/49 |
| 5,366,853 | 11/1994 | Yoshimoto | 430/458 |

FOREIGN PATENT DOCUMENTS

| | | |
|---|---|---|
| 0546778 | 6/1993 | European Pat. Off. . |
| 2-109042 | 4/1990 | Japan . |
| 4-237045 | 8/1992 | Japan . |
| 5-119454 | 5/1993 | Japan . |
| 5-165174 | 6/1993 | Japan . |
| 5-232656 | 9/1993 | Japan . |
| 6/130572 | 5/1994 | Japan . |

*Primary Examiner*—Hoa Van Le
*Attorney, Agent, or Firm*—Finnegan, Henderson, Farabow, Garrett & Dunner

[57] ABSTRACT

A solid processing composition for providing fixer or bleach-fixer of a silver halide photographic light-sensitive material is disclosed, wherein the composition comprises a sugar alcohol and at least one of a thiosulfate salt and a thiocyanate salt.

9 Claims, No Drawings

SOLID PROCESSING COMPOSITION FOR SILVER HALIDE PHOTOGRAPHIC LIGHT-SENSITIVE MATERIALS

FIELD OF THE INVENTION

The invention relates to a solid processing composition for a silver halide color photographic light-sensitive material, and particularly to a solid processing composition for a silver halide photographic light-sensitive material having excellent storage stability and solubility, and having markedly improved stability.

BACKGROUND OF THE INVENTION

A silver halide photographic light-sensitive material is photographically processed through a development step, a bleaching step, a washing step and a stabilization step after being exposed. The photographic processing is ordinarily conducted using an automatic processing machine. On such occasions, a replenisher replenishing system is commonly used wherein the processing solution in a processing tank is controlled so that the activity thereof is kept constant. In the case of the replenisher replenishing system, the purposes thereof include dilution of materials dissolved out from the light-sensitive material, correction of the amount of evaporation and replenishment of consumed components. Because of solution replenishing, much overflow-solution is ordinarily discharged.

Recently, world wide movements for regulations on prohibiting dumping photo-effluent into oceans and regulations against disposal of plastic materials have been promoted. Accordingly, development of a new system in which photographic waste solution is markedly reduced and bottles for processing agents are eliminated is demanded. In addition, safety regulations on packaging materials have been made strengthened to maintain safety regarding the transportation of liquid hazardous substances, resulting in an increase of cost. In mini-labs which have recently proliferated rapidly, errors frequently occur during dissolution or dilution operations of the replenishing solutions due to a lack of man power. Therefore, this conventional replenishment system has drawn much frequent complaints.

Accordingly, in the photographic industry a new replenishing system is demanded in which photographic waste solution is markedly reduced, bottles for processing agents are eliminated and dissolving operations are also eliminated.

In response to these demands Japanese Patent O.P.I Publication No. 5-119454/1993 discloses a method of tableting almost all processing components and directly supplying tablets in processing tanks. Japanese Patent O.P.I Publication No. 4-237045/1992 discloses a method of setting powdered processing agents in part in automatic processors, and directly supplying them in processing tanks after weighing the necessary amounts. Further, Japanese Patent O.P.I Publication No. 2-109042/1990 discloses a method of using a granulated processing agent. These references are common in disclosing using a solid chemical instead of the conventional solution processing agent. However, the preceding two disclose directly supplying the solid processing agent in processing tanks, and the latter one discloses dissolving the solid processing agent to obtain replenishing solutions.

In order to produce a solid processing agent such as a granulated processing agent, processing agents are pulverized, granulated adding water and then dried to obtain the granulated processing agent. Tablets can be produced by compressing and molding the granulated processing agent or a powdered processing agent. The above references disclose the tablet production in this manner. However, the inventor has found that, although the solid processing composition can be obtained by the above conventional method, there are problems regarding storage stability in the case of a fixing or fix-bleach composition comprising a thiosulfate.

Japanese Patent O.P.I Publication No. 5-165174/1993 discloses the solid processing composition comprising a thiosulfate salt and having an ammonium ion content not more than 50 mol % based on the total cation content. Japanese Patent O.P.I. Publication No. 5-232656/1993 discloses the solid processing composition comprising a thiosulfate salt and a thiocyanate salt. However, these references only disclose storage stability of the solid composition tightly packed by a packaging material after its production, and fail to disclose storage stability of the solid composition unpacked and allowed to stand at an arbitrary temperature and humidity. The inventor has made an extensive study as to the relationship between the solid composition comprising a thiosulfate salt and/or a thiocyanate salt and storage conditions, and found that the solid processing composition comprising a specific additive reduces hygroscopicity of a thiosulfate salt or a thiocyanate salt and exhibits an excellent storage stability whether packed or not.

SUMMARY OF THE INVENTION

A first object of the invention is to provide a solid processing composition for a silver halide photographic light-sensitive material eliminating dilution by hand of a concentrated processing solution, and enabling an automatic, highly reliable replenishing system.

A second object of the invention is to provide a solid processing compositions for a silver halide photographic light-sensitive material eliminating a bottle for the processing solution, markedly reducing a plastic packaging material and enabling earth friendly system avoiding pollution.

A third object of the invention is to provide a solid processing composition for a silver halide photographic light-sensitive material enabling a stable productivity, having a low abrasion, excellent storage stability and solubility, and giving stable photographic properties.

DETAILED DESCRIPTION OF THE INVENTION

The above objects of the invention can be obtained by the following.

1) A solid processing composition for a silver halide photographic light-sensitive material comprising a sugar alcohol and at least one of a thiosulfate salt and a thiocyanate salt.

2) The solid processing composition for a silver halide photographic light-sensitive material of the above 1), wherein the composition is in a granule form.

3) The solid processing composition for a silver halide photographic light-sensitive material of the above 1) or 2), wherein the composition has an ammonium ion content not more than 90 mol % based on the total cation content.

4) The solid processing composition of the above 1), 2) or 3), wherein the sugar alcohol content is 0.5 to 20.0% by weight.

5) The solid processing composition of the above 1), 2), 3) or 4), wherein the composition has an average particle diameter of 100 to 2000 μm.

6) The solid processing composition of the above 1), 2), 3), 4) or 5), wherein the weight loss of the composition on drying at 80° C. for 20 minutes is 0.5 to 5.0% by weight.

7) The solid processing composition of the above 1), wherein the composition is in a tablet form.

8) The solid processing composition of the above 7), wherein the composition has an ammonium ion content not more than 90 mol % based on the total cation content.

9) The solid processing composition of the above 7) or 8), wherein the sugar alcohol content is 0.5 to 20.0% by weight.

10) The solid processing composition of the above 7), 8) or 9), wherein the composition is obtained by compression-molding granules having an average particle diameter of 100 to 2000 μm.

11) The solid processing composition of the above 7), 8), 9) or 10), wherein the weight loss of the composition on drying at 80° C. for 20 minutes is 0.5 to 5.0% by weight.

The solid processing composition comprising a thiosulfate salt and/or a thiocyanate salt is well known, however, the present inventor has found that the solid composition, powder or granules, causes blocking phenomenon that the powder or granules aggregates each other, causing a serious problem as a photographic processing composition.

More concretely, the blocking phenomenon results in poor productivity and a great increase of production cost as well as deterioration of dissolution operation efficiency. If the worst comes to the worst, there occurs a serious problem that the solubility of the composition deteriorates to produce precipitates in the bottom of the solution vessel.

The solid processing tablet comprising a thiosulfate salt and/or a thiocyanate salt has problems such as poor solubility due to the blocking phenomenon, poor lubricity due to deterioration of smoothness of the tablet surface and marked abrasion of tablets due to vibration impacts on transporting. As a result, the tablet is commercially worthless, and there also occurs a serious problem of poor operation environment due to loose powder.

The object of the invention is to prevent the blocking phenomenon as above of the solid processing composition comprising a thiosulfate salt and/or a thiocyanate salt.

The inventors have found that selection of materials combining with the thiosulfate salt or thiocyanate salt has improved results in the prevention of the blocking phenomenon, and the addition of a sugar alcohol prevents the blocking phenomenon and the abrasion of tablets due to impacts, for example, vibration on transporting or handling.

The solid processing composition of the invention is in the form of powder, granules or tablets, and preferably in the form of granules or tablets. It is in the form of tablets that exhibits the effects of the invention most markedly, in view of solubility, one of the effects of the invention.

The powder referred to in the invention herein is an aggregation of fine crystals. The granules referred to in the invention are obtained by granulating the powder, and the granules have a particle diameter within the range of 50 to 5000μm. The tablet refers to one obtained by compression-molding powder or granules into a definite form. The molding method for obtaining tablets includes tableting only powder, tableting a mixture of powder and granules, or tableting only granules. In view of the effects of the invention, solubility and storage stability, the composition comprising granules are preferably tableted and the composition substantially consisting of granules is more preferably tableted. The composition substantially consisting of granules includes the composition to which powdered lubricant is added for the purpose of improving tableting operation, lubricity of granules and so forth.

As for the granulating processes for forming granules or tablets, it is possible to use any of the well-known processes such as the processes of a rolling granulation, an extrusion granulation, a compression granulation, a cracking granulation, a stirring granulation, a fluidized-layer granulation and a spray-dry granulation. The average particle diameter of the granules is preferably 100 to 2000 μm, and more preferably 200 to 1500μm, in that localization of components or so-called segregation occurs with difficulty and in view of the effects of the invention. As to particle diameter distribution, not less than 50% of the granules have a particle diameter farting within a deviation of preferably ±200 to 250 μm. The average particle diameter of the invention refers to weight average particle diameter. The weight average particle diameter of the invention is measured using a sieve according to Japanese Industrial Standards, and calculated by the following equation.

$$L_{ave}=\Sigma\ (W_i \times L_i)/\ \Sigma\ W_i$$

wherein $L_{ave}$ represents a weight average particle diameter, $W_i$ represents weight of particles remained on the i-th sieve and $L_i$ represents a size of the i-th sieve mesh. In the invention particles were sieved with sieves having a mesh size of 3360, 2830, 2000, 1410, 1000, 710, 500, 350, 210, 149, 105 and 37 μm. The granules are used as they are. When the granules are compressed, the well known compressors such as a hydraulic press machine, a single tableting machine, a rotary tableting machine and a bricketing machine can be used.

The resulting solid processing composition may be in any form, and preferably in cylindrical form in view of productivity, handling or loose powder occurred in use.

The solid processing composition of the invention containing a sugar alcohol and a thiosulfate or a thiocyanate wherein the weight loss of the composition on drying at 80° C. is 0.5 to 5.0% by weight has an advantage in that lubricity is improved and loosen powder is reduced after tightly closed and stored. The weight loss of the composition on drying at 80° C. in the invention is obtained by heating the composition at 80° C. for 20 minutes in the electronic moisture tester available on the market and measuring the weight reduction.

The solid processing composition of the invention comprises a thiosulfate salt or a thiocyanate salt, and the salt includes an ammonium, potassium or sodium salt. It is preferable that the ammonium ion content is preferably 0 to 90 mol %, more preferably 0 to 60 mol %, and most preferably 0 to 40 mol % based on the total cation content.

It has been proved that, when the ammonium ion content exceeds 90 mol %, the solid processing composition comprising a thiosulfate salt or a thiocyanate salt tends to be hygroscopic and cause blocking phenomenon, and the effects of the invention deteriorate.

It is essential that the solid processing composition of the invention comprise a sugar alcohol.

The sugar alcohol of the invention refers to a multivalent alcohol having a primary or secondary alcohol group to which an aldehyde or ketone group of saccharides has been reduced.

Examples of the sugar alcohol in the invention will be shown below.

| | |
|---|---|
| B-1 | Glycerin |
| B-2 | D-threitol |
| B-3 | L-threitol |
| B-4 | meso-erythritol |
| B-5 | D-arabitol |
| B-6 | L-arabitol |
| B-7 | adnite |
| B-8 | xylitol |
| B-9 | D-sorbitol |
| B-10 | L-sorbitol |
| B-11 | D-mannitol |
| B-12 | L-mannitol |
| B-13 | D-iditol |
| B-14 | L-iditol |
| B-15 | D-talitol |
| B-16 | L-talitol |
| B-17 | dulcin |
| B-18 | allodulcitol |
| B-19 | D-erythritol |
| B-20 | L-Erythritol |

Of these compounds, B-9 through B-20 are preferably used.

The content of the sugar alcohol in the solid processing composition of the invention is 0.5 to 20% by weight, and preferably 1.0 to 15% by weight.

The solid processing composition of the invention comprising a thiosulfate and/or a thiocyanate is employed as a solid processing agent for providing fixer or bleach-fixer as well as any other photographic processing agent.

The content of a thiosulfate or a thiocyanate in the solid composition of the invention is preferably 10 to 99.5% by weight.

The solid fixing composition may contain, in addition to a thiosulfate and/or a thiocyanate, conventional fixing components, a sulfite (for example, sodium sulfite, potassium sulfite, lithium sulfite or ammonium sulfite), a bisulfite (for example, sodium bisulfite, potassium bisulfite or ammonium bisulfite), a metabisulfite (for example, sodium metabisulfite or potassium metabisulfite), a sulfite adduct (for example, compounds represented by Formula (A) disclosed in Japanese Patent O.P.I. Publication No. 5-341455), a mesoionic compound, a thioether, a chelating agent (for example, compounds represented by Formulae [A-I] to [A-III] and [A'] disclosed in columns 0018 to 0043 of Japanese Patent O.P.I. Publication No. 6-43604, chelating agents constituting ferric complexes disclosed in columns 0066 to 0127 of Japanese Patent O.P.I. Publication No. 6-95318, chelating agents [1] to [20] constituting ferric complexes disclosed in Japanese Patent O.P.I. Publication No. 4-158359 or exemplified chetating agents disclosed in Japanese Patent O.P.I. Publication No. 3-243948), a nonionic or anionic surfactant and a buffering agent. The solid bleach-fixing composition may contain, in addition to the above components, conventional bleaching or fixing components such as a halide, a conventional organic acid ferric salt including a ferric aminopolycarboxylic acid (for example, ferric complex of the above chelating agent), an organic acid, a fungicide and a preservative.

The solid processing composition in the invention is preferably replenished in an amount of 0.5 to 50 g per unit replenishing amount. The unit replenishing amount refers to a weight amount replenished every time a definite amount of a silver halide photographic light-sensitive material is processed. When the amount exceeds 50 g, the precipitations are likely to occur in the case of granules and particularly in the case of tablets. When the amount is too a little, there occur problems of replenishing reliability or durability of replenishing means since replenishing opportunities increase. Further, there are problems that the composition absorbs moisture since an atmosphere of high humidity is frequently introduced into the replenishing means on account of increasing replenishing opportunities.

EXAMPLES

The present invention will be detailed in the following Examples.

Example 1

A replenishing granule sample for fixer of a color film was prepared by the following Procedure.

Procedure A

In a hammer-mill available on the market the fixing agent shown in Tables 1 and 2, 180 g of sodium sulfite, 20 g of potassium carbonate, 20 g of disodium ethylenediaminetetraacetate and additive shown in Tables 1 and 2 were pulverized up to have an average particle size of 30 μm. The resulting fine particles were granulated by adding 50 ml of water thereto at a room temperature for 10 minutes in a stirring granulator. Thereafter, the granules were dried at 60° C. for 120 minutes in a fluid-bed type drier to completely remove the moisture. Then, the dried granules were classified so that the granules have an average particle diameter of 700 μm and not less than 50% of the granules have a particle diameter falling within a deviation of ±200 to ±250 μm.

Thirty grams of each of the granules prepared above were allowed to stand at 25° C. and 50% RH for one week. Thereafter, appearance of the granules were observed and the average diameter of the granules was measured. Further, the granules was incorporated in 100 cc of water at 25° C. and the time necessary to completely dissolve was measured.

The results are shown in Tables 1 and 2.

TABLE 1

| Experiment Nos. | Fixing Agent | (g) | Additive | (g) | Appearance of the Granules | Average Particle Diameter after one week storage | Time necessary to completely dissolve (min.) |
|---|---|---|---|---|---|---|---|
| 1-1 (Comp.) | Ammonium thiosulfate | 2500 | — | | Blocking occurs to form an aggregation | 13 mm | 92 |
| 1-2 (Inv.) | Ammonium thiosulfate | 2500 | B-1 | 70 | Blocking partly occurs | 2600 μm | 59 |
| 1-3 (Inv.) | Ammonium thiosulfate | 2500 | B-4 | 70 | Blocking partly occurs | 2200 μm | 53 |
| 1-4 (Inv.) | Ammonium thiosulfate | 2500 | B-9 | 70 | No problem | 950 μm | 31 |
| 1-5 (Inv.) | Ammonium thiosulfate | 2500 | B-11 | 70 | No problem | 820 μm | 26 |

TABLE 1-continued

| Experiment Nos. | Fixing Agent | (g) | Additive | (g) | Appearance of the Granules | Average Particle Diameter after one week storage | Time necessary to completely dissolve (min.) |
|---|---|---|---|---|---|---|---|
| 1-6 (Inv.) | Ammonium thiosulfate | 2500 | B-12 | 70 | No problem | 810 μm | 25 |
| 1-7 (Inv.) | Ammonium thiosulfate | 2500 | B-17 | 70 | No problem | 990 μm | 36 |
| 1-8 (Comp.) | Ammonium thiosulfate | 2500 | PVA | 70 | Blocking occurs to form an aggregation | 11 mm | 83 |
| 1-9 (Comp.) | Ammonium thiosulfate | 2500 | Polyvinyl pyrrolidone | 70 | Blocking occurs to form an aggregation | 8 mm | 69 |
| 1-10 (Comp.) | Ammonium thiosulfate | 2500 | PEG 6000 | 70 | Blocking partly occurs | 2500 μm | 91 |
| 1-11 (Comp.) | Ammonium thiosulfate | 2500 | PEG 4000 | 70 | Blocking partly occurs | 3000 μm | 85 |

PVA: polyvinyl alcohol, average molecular weight: 500
Polyvinyl pyrrolidone: polyvinyl pyrrolidone K-17
PEG: polyethylene glycol

TABEL 2

| Experiment Nos. | Fixing Agent | (g) | Additive | (g) | Appearance of the Granules | Average Particle Diameter after one week storage | Time necessary to completely dissolve (min.) |
|---|---|---|---|---|---|---|---|
| 1-12 (Comp.) | Potassium thiocyanate | 2000 | — | | Blocking occurs to form an aggregation | 12 mm | 89 |
| 1-13 (Inv.) | Potassium thiocyanate | 2000 | B-1 | 70 | Blocking partly occurs | 2400 μm | 42 |
| 1-14 (Inv.) | Potassium thiocyanate | 2000 | B-11 | 70 | No problem | 820 μm | 18 |
| 1-15 (Inv.) | Potassium thiocyanate | 2000 | B-12 | 70 | No problem | 800 μm | 19 |
| 1-16 (Inv.) | Potassium thiocyanate | 2000 | B-17 | 70 | No problem | 890 μm | 30 |
| 1-17 (Comp.) | Potassium thiocyanate | 2000 | PVA | 70 | Blocking occurs to form an aggregation | 10 mm | 89 |
| 1-18 (Comp.) | Potassium thiocyanate | 2000 | Polyvinyl pyrrolidone | 70 | Blocking occurs to form an aggregation | 11 mm | 92 |
| 1-19 (Comp.) | Potassium thiocyanate | 2000 | PEG 6000 | 70 | Blocking partly occurs | 3000 μm | 72 |
| 1-20 (Comp.) | Potassium thiocyanate | 2000 | PEG 4000 | 70 | Blocking partly occurs | 3600 μm | 79 |
| 1-21 (Comp.) | Ammonium thiosulfate<br>Potassium thiocyanate | 1500<br>1000 | — | | Blocking occurs to form an aggregation | 13 mm | 96 |
| 1-22 (Inv.) | Ammonium thiosulfate<br>Potassium thiocyanate | 1500<br>1000 | B-11 | 70 | No problem | 840 μm | 27 |
| 1-23 (Inv.) | Ammonium thiosulfate<br>Potassium thiocyanate | 1500<br>1000 | B-12 | 70 | No problem | 830 μm | 24 |
| 1-24 (Comp.) | Ammonium thiosulfate<br>Potassium thiocyanate | 1500<br>1000 | PVA | 70 | Blocking occurs to form an aggregation | 12 mm | 98 |
| 1-25 (Comp.) | Ammonium thiosulfate<br>Potassium thiocyanate | 1500<br>1000 | PEG 6000 | 70 | Blocking partly occurs | 2800 μm | 76 |

PVA: polyvinyl alcohol, average molecular weight: 500
Polyvinyl pyrrolidone: polyvinyl pyrrolidone K-17
PEG: polyethylene glycol As is apparent from Tables 1 and 2, the inventive samples shows improved results in the prevention of blocking and solubility.

It has been proved that, as sugar alcohols, Nos. B-9, 11, 12 and 17 are preferable.

Example 2

Procedure (B)

The granules obtained in Example 1 were mixed with 27 g of N-lauroyl sarcosine sodium salt at 25° C. and 45% RH for 5 minutes through a mixer. Thereafter, the resulting mixture granules were tableted, making use of a modified tabulating machine (Tough Press Correct 1527HU manufactured by Kikusui Mfg. Works) to obtain a tablet having a diameter of 30 mm, a thickness of 10.0 mm and a weight of 10.0 g.

The tablet samples obtained above were stored at 25° C. and 60% RH for a week. Thereafter, five tablets were placed in the tablet abrasion tester (produced by Kayagaki Irika-kogyou Co. Ltd.) and were rotated at a rate of 25 rounds per minute for 5 minutes. Then, the powder on the surface of the tablets were wiped away by a brush and the degree of abrasion was calculated by the following equation:

Degree of Abrasion (%) =
(total weight of tablets before the test − total weight of tablets after the test)/(total weight of tablets before the test) × 100

Water was added to three tablet samples to make a 100 cc solution, and the solubility was evaluated in the same manner as in Example 1.

The results are shown in Table 3.

TABLE 3

| Experiment Nos. | Fixing Agent | (g) | Additive | (g) | Abrasion Degree of Tablets (%) | Time necessary to dissolve (min.) |
|---|---|---|---|---|---|---|
| 2-1 (Comp.) | Ammonium thiosulfate | 2500 | — | | 3.60 | more than 100 |
| 2-2 (Inv.) | Ammonium thiosulfate | 2500 | B-1 | 70 | 0.74 | 51 |
| 2-3 (Inv.) | Ammonium thiosulfate | 2500 | B-4 | 70 | 0.76 | 53 |
| 2-4 (Inv.) | Ammonium thiosulfate | 2500 | B-9 | 70 | 0.39 | 41 |
| 2-5 (Inv.) | Ammonium thiosulfate | 2500 | B-11 | 70 | 0.27 | 27 |
| 2-6 (Inv.) | Ammonium thiosulfate | 2500 | B-12 | 70 | 0.29 | 29 |
| 2-7 (Comp.) | Ammonium thiosulfate | 2500 | PVA | 70 | 3.78 | more than 100 |
| 2-8 (Comp.) | Ammonium thiosulfate | 2500 | PEG 6000 | 70 | 3.20 | more than 100 |
| 2-9 (Comp.) | Ammonium thiosulfate | 2500 | PEG 4000 | 70 | 3.50 | more than 100 |
| 2-10 (Comp.) | Potassium thiocyanate | 2500 | — | | 4.20 | more than 100 |
| 2-11 (Inv.) | Potassium thiocyanate | 2500 | B-1 | 70 | 0.83 | 53 |
| 2-12 (Inv.) | Potassium thiocyanate | 2500 | B-11 | 70 | 0.25 | 24 |
| 2-13 (Inv.) | Potassium thiocyanate | 2500 | B-12 | 70 | 0.27 | 31 |
| 2-14 (Inv.) | Potassium thiocyanate | 2500 | B-17 | 70 | 0.83 | 58 |
| 2-15 (Comp.) | Potassium thiocyanate | 2500 | PVA | 70 | 4.40 | more than 100 |
| 2-16 (Comp.) | Potassium thiocyanate | 2500 | PEG 6000 | 70 | 4.00 | more than 100 |
| 2-17 (Comp.) | Potassium thiocyanate | 2500 | PEG 4000 | 70 | 4.20 | 90 |
| 2-18 (Comp.) | Ammonium thiosulfate | 1500 | — | | 4.90 | more than 100 |
| | Potassium thiocyanate | 1000 | | | | |
| 2-19 (Inv.) | Ammonium thiosulfate | 1500 | B-11 | 70 | 0.25 | 39 |
| | Potassium thiocyanate | 1000 | | | | |
| 2-20 (Inv.) | Ammonium thiosulfate | 1500 | B-12 | 70 | 0.26 | 43 |
| | Potassium thiocyanate | 1000 | | | | |
| 2-21 (Comp.) | Ammonium thiosulfate | 1500 | PVA | 70 | 5.10 | more than 100 |
| | Potassium thiocyanate | 1000 | | | | |
| 2-22 (Comp.) | Ammonium thiosulfate | 1500 | PEG 6000 | 70 | 4.70 | more than 100 |
| | Potassium thiocyanate | 1000 | | | | |

PVA: polyvinyl alcohol, average moleculare weight: 500
PEG: polyethylene glycol

As is apparent from Table 3, the inventive samples shows improved results in the abrasion degree due to aging and in solubility.

Example 3

The tablets were prepared in the same manner as in Example 2, except that an additive and the amount thereof were varied as shown in Table 4. The resulting tablets were evaluated in the same manner as in Example 2.

The results are shown in Table 4.

TABLE 4

| Experiment Nos. | Fixing Agent | (g) | Additive | (g) | % (w/w) | Abrasion Degree of Tablets (%) | Time necessary to dissolve (min.) |
|---|---|---|---|---|---|---|---|
| 3-1 (Inv.) | Ammonium thiosulfate | 2500 | B-11 | 10 | 0.36 | 0.88 | 69 |
| 3-2 (Inv.) | Ammonium thiosulfate | 2500 | B-11 | 15 | 0.54 | 0.47 | 53 |
| 3-3 (Inv.) | Ammonium thiosulfate | 2500 | B-11 | 20 | 0.72 | 0.41 | 36 |
| 3-4 (Inv.) | Ammonium thiosulfate | 2500 | B-11 | 30 | 1.08 | 0.29 | 33 |
| 3-5 (Inv.) | Ammonium thiosulfate | 2500 | B-11 | 70 | 2.48 | 0.27 | 27 |
| 3-6 (Inv.) | Ammonium thiosulfate | 2500 | B-11 | 200 | 6.79 | 0.26 | 33 |
| 3-7 (Inv.) | Ammonium thiosulfate | 2500 | B-11 | 500 | 15.40 | 0.28 | 58 |
| 3-8 (Inv.) | Ammonium thiosulfate | 2500 | B-11 | 700 | 20.30 | 0.31 | 78 |
| 3-9 (Inv.) | Ammonium thiosulfate | 2500 | B-11 | 900 | 24.68 | 0.33 | 83 |
| 3-10 (Comp.) | Ammonium thiosulfate | 2500 | PVA | 10 | 0.36 | 3.70 | more than 100 |
| 3-11 (Comp.) | Ammonium thiosulfate | 2500 | PVA | 70 | 2.48 | 3.78 | more than 100 |
| 3-12 (Comp.) | Ammonium thiosulfate | 2500 | PVA | 500 | 20.30 | 3.83 | more than 100 |
| 3-13 (Comp.) | Ammonium thiosulfate | 2500 | PVA | 900 | 24.68 | 3.81 | more than 100 |

PVA: polyvinyl alcohol, average molecular weight: 500

As is apparent from Table 4, the inventive samples show preferable results in view of abrasion degree and in solubility, when the content of the additive of the invention is 0.5 to 20% by weight, and more preferable results, when the content of the additive of the invention is 1.0 to 15.0% by weight.

Example 4

The tablets were prepared in the same manner as in Example 3, except that an additive was changed to A-18, B-1, B-4, B-9, B-11, B-12, B-13 and B-17, and evaluated in the same manner as in Example 3. The substantially same results as Example 3 were obtained.

Example 5

The granules were prepared in the same manner as in Example 1, except that the cation content of the compounds used was changed as shown in Table 5, and tablets were prepared from the resulting granules in the same manner as in Example 2.

The tablet samples obtained above were stored at 25° C. and 50% RH for a week. Thereafter, coefficient of moisture absorption of the tablets was measured, and further, the tablets were evaluated in the same manner as in Example 2.

The results are shown in Table 5.

TABLE 5

| | | Ammonium Cation | | | | Tablets | | |
|---|---|---|---|---|---|---|---|---|
| Experiment Nos. | Fixing Agent | (g) | Content based on the Total Cation Content (mol %) | Additive | (g) | Coefficient of Moisture Absorption (%) | Abrasion Degree (%) | Time necessary to dissolve (min.) |
| 5-1 (Comp.) | Thiosulfate Salt | 2500 | 100 | — | | 12.7 | 4.1 | more than 100 |
| 5-2 (Comp.) | Thiosulfate Salt | 2500 | 90 | — | | 6.3 | 3.5 | more than 100 |
| 5-3 (Comp.) | Thiosulfate Salt | 2500 | 80 | — | | 5.6 | 3.3 | more than 100 |
| 5-4 (Comp.) | Thiosulfate Salt | 2500 | 60 | — | | 3.9 | 3.2 | more than 100 |
| 5-5 (Comp.) | Thiosulfate Salt | 2500 | 40 | — | | 3.8 | 3.3 | more than 100 |
| 5-6 (Comp.) | Thiosulfate Salt | 2500 | 20 | — | | 3.6 | 3.1 | more than 100 |
| 5-7 (Inv.) | Thiosulfate Salt | 2500 | 100 | B-11 | 70 | 10.9 | 0.59 | 36 |

TABLE 5-continued

| Experiment Nos. | Fixing Agent | Ammonium Cation (g) | Content based on the Total Cation Content (mol %) | Additive | (g) | Tablets Coefficient of Moisture Absorption (%) | Abrasion Degree (%) | Time necessary to dissolve (min.) |
|---|---|---|---|---|---|---|---|---|
| 5-8 (Inv.) | Thiosulfate Salt | 2500 | 90 | B-11 | 70 | 3.8 | 0.33 | 28 |
| 5-9 (Inv.) | Thiosulfate Salt | 2500 | 80 | B-11 | 70 | 3.3 | 0.27 | 23 |
| 5-10 (Inv.) | Thiosulfate Salt | 2500 | 60 | B-11 | 70 | 2.2 | 0.15 | 22 |
| 5-11 (Inv.) | Thiosulfate Salt | 2500 | 40 | B-11 | 70 | 1.1 | 0.10 | 20 |
| 5-12 (Inv.) | Thiosulfate Salt | 2500 | 20 | B-11 | 70 | 1.0 | 0.09 | 21 |
| 5-13 (Comp.) | Thiosulfate Salt | 1500 | 100 | — | | 14.5 | 5.2 | more than 100 |
| | Thiocyanate Salt | 1000 | | | | | | |
| 5-14 (Comp.) | Thiosulfate Salt | 1500 | 90 | — | | 7.1 | 5.1 | more than 100 |
| | Thiocyanate Salt | 1000 | | | | | | |
| 5-15 (Comp.) | Thiosulfate Salt | 1500 | 60 | — | | 6.0 | 4.4 | more than 100 |
| | Thiocyanate Salt | 1000 | | | | | | |
| 5-16 (Comp.) | Thiosulfate Salt | 1500 | 40 | — | | 5.3 | 4.5 | more than 100 |
| | Thiocyanate Salt | 1000 | | | | | | |
| 5-17 (Inv.) | Thiosulfate Salt | 1500 | 100 | B-11 | 70 | 11.5 | 0.71 | 51 |
| | Thiocyanate Salt | 1000 | | | | | | |
| 5-18 (Inv.) | Thiosulfate Salt | 1500 | 90 | B-11 | 70 | 4.3 | 0.39 | 43 |
| | Thiocyanate Salt | 1000 | | | | | | |
| 5-19 (Inv.) | Thiosulfate Salt | 1500 | 60 | B-11 | 70 | 2.9 | 0.29 | 31 |
| | Thiocyanate Salt | 1000 | | | | | | |
| 5-20 (Inv.) | Thiosulfate Salt | 1500 | 40 | B-11 | 70 | 1.7 | 0.21 | 26 |
| | Thiocyanate Salt | 1000 | | | | | | |

As is apparent from Table 5, the inventive samples shows the effects of the invention, preferably when the ammonium ion content is not more than 90mol %, more preferably when the ammonium ion content is not more than 60mol %, and most preferably when the ammonium ion content is not more than 40mol %.

Example 6

A tablet sample for bleach-fixer of a color paper was prepared by the following Procedure.

Procedure (C)

In a hammer-mill available on the market 720 g of ammonium ferric diethylenetriaminepentaacetate, 70 g of diethylenetriaminepentaacetatic acid and additive (a) (shown in Table 6) were pulverized. The resulting fine particles were granulated while adding 10 ml of water thereto at a room temperature for 10 minutes in a stirring granulator. Thereafter, the granules were dried at 60° C. for 2 hours to completely remove the moisture.

Procedure (D)

Fixing agent (shown in Table 6), 160 g of sodium sulfite, 60 g of sodium bisulfite and additive (b) (shown in Table 6) were pulverized up, mixed and granulated in the same manner as in Procedure (A). The addition amount of water was 40 ml. Thereafter, the granules were dried at 60° C. for 120 minutes to completely remove the moisture.

The granules obtained in Procedures (C) and (D) were mixed with 10 g of N-lauroyl sarcosine sodium salt at 25° C. and 45% RH for 5 minutes through a mixer. Thereafter, the resulting mixture granules were tableted, making use of a modified tableting machine (Tough Press Correct 1527HU manufactured by Kikusui Mfg. Works) to obtain a tablet having a diameter of 30 mm, a thickness of 10.0 mm and a weight of 10.0 g. The tablets were evaluated in the same manner as in Example 2.

Four tablets were dissolved in water to make a 100 ml solution and the solubility thereof was evaluated. The results are shown in Table 6.

TABLE 6

| Experiment Nos. | Fixing Agent | (g) | Additive (a) | (g) | Additive (b) | (g) | Abrasion degree (%) | Time necessary to completely dissolve (min.) |
|---|---|---|---|---|---|---|---|---|
| 6-1 (Comp.) | Ammonium thiosulfate | 800 | none | | none | | 5.6 | 96 |
| 6-2 (Inv.) | Ammonium thiosulfate | 800 | B-9 | 80 | B-9 | 60 | 0.41 | 53 |
| 6-3 (Inv.) | Ammonium thiosulfate | 800 | B-11 | 80 | B-11 | 60 | 0.36 | 35 |
| 6-4 (Inv.) | Ammonium thiosulfate | 800 | B-12 | 80 | B-12 | 60 | 0.37 | 40 |
| 6-5 (Inv.) | Ammonium thiosulfate | 800 | PEG 6000 | 80 | B-11 | 60 | 0.41 | 40 |
| 6-6 (Comp.) | Ammonium thiosulfate | 800 | PVA | 80 | PVA | 60 | 6.1 | more than 100 |
| 6-7 (Comp.) | Ammonium thiosulfate | 800 | PEG 6000 | 80 | PEG 6000 | 60 | 5.5 | 52 |
| 6-8 (Comp.) | Ammonium thiosulfate | 600 | none | | none | | 6.3 | more than 100 |
| | Potassium thiocyanate | 200 | | | | | | |
| 6-9 (Inv.) | Ammonium thiosulfate | 600 | B-9 | 80 | B-9 | 60 | 0.61 | 60 |
| | Potassium thiocyanate | 200 | | | | | | |
| 6-10 (Inv.) | Ammonium thiosulfate | 600 | B-11 | 80 | B-11 | 60 | 0.47 | 50 |
| | Potassium thiocyanate | 200 | | | | | | |
| 6-11 (Inv.) | Ammonium thiosulfate | 600 | B-12 | 80 | B-12 | 60 | 0.51 | 53 |
| | Potassium thiocyanate | 200 | | | | | | |
| 6-12 (Inv.) | Ammonium thiosulfate | 600 | PEG 6000 | 80 | B-11 | 60 | 0.53 | 51 |
| | Potassium thiocyanate | 200 | | | | | | |

TABLE 6-continued

| Experiment Nos. | Fixing Agent | (g) | Additive (a) | (g) | Additive (b) | (g) | Abrasion degree (%) | Time necessary to completely dissolve (min.) |
|---|---|---|---|---|---|---|---|---|
| 6-13 (Comp.) | Ammonium thiosulfate | 600 | PVA | 80 | PVA | 60 | 6.9 | more than 100 |
| | Potassium thiocyanate | 200 | | | | | | |
| 6-14 (Comp.) | Ammonium thiosulfate | 600 | PEG 6000 | 80 | PEG 6000 | 60 | 6.5 | 71 |
| | Poatssium thiocyanate | 200 | | | | | | |

PVA: polyvinyl alcohol, average molecular weight: 500
PEG: polyethylene glycol

As is apparent from Table 6, the inventive samples shows the same improved results in the tablets for bleach-fixer as in the tablets for fixer.

Example 7

Procedure E

In a hammer-mill available on the market the fixing agent shown in Table 7, 180 g of sodium sulfite, 20 g of potassium carbonate, 20 g of disodium ethylenediamine-tetraacetate and additive shown in Table 7 were pulverized up to have an average particle size of 50 μm. The resulting fine particles were granulated by adding water thereto at a room temperature for 10 minutes in a stirring granulator available on the market. Then, the granules were dried at 60° C. in a fluid-bed type drier so that the granules have an average particle diameter of 200 to 1500 μm and not less than 50% of the granules have a deviation within the range of ±200 to ±250 μm.

The adding amount of water and drying time on granulating were adjusted to obtain the weight loss of the finally obtained granules on drying at 80° C. for 20 minutes as shown in Table 7.

The granules obtained in above were mixed with N-lauroyl sarcosine sodium salt (having a particle diameter of not more than 100 μm) in an amount of 0.5% by weight at 25° C. and 45% RH for 5 minutes through a cross-rotary type mixer available on the market. Thereafter, the resulting mixture granules were tableted, making use of a modified tabulating machine (Tough Press Correct 1527HU manufactured by Kikusui Mfg. Works) to obtain a tablet having a diameter of 30 mm, a thickness of 10 mm and a weight of 10.0 g.

The tablet samples obtained above were placed in an aluminium package, tightly closed and stored at 25° C. and 50% RH for a week. Thereafter, one tablet was placed in a polyethylene plate fixed by Static Friction Tester HEIDO N-10 (produced by HEIDO Co., Ltd.) at 25° C. and 50% RH. Then, the plate was inclined and the angle θ at which the tablet on the plate moves was measured for lubricity. The measurement was repeated twice.

The evaluation criterions are as follows:

A: Two tablets both move at not more than angle 15°.

B: One tablet moves at not more than angle 15°, and the other moves at angle 15° to 30°.

C: Two tablets both move at angle 15° to 30°.

D: Two tablets both move at more than 30°.

The vibration test of two tablets was carried out at 5–67 Hz/210 seconds for 30 minutes using a vibration tester BF-UA produced by IDEX Co., Ltd.

The evaluation criterions are as follows:

A: No problem.

B: One tablet slightly produces powder, but the powder was not flown.

C: Two tablets slightly produce powder, but the powder was not flown.

D: Two tablets both markedly produce powder, and the powder flew.

The results are shown in Tables 7.

TABLE 7

| Experiment Nos. | Fixing Agent | (g) | Additive | (g) | Weight Loss on Drying at 80° C. | Lubricity | Vibration Test |
|---|---|---|---|---|---|---|---|
| 7-1 (Inv.) | Ammonium thiosulfate | 2500 | B-9 | 70 | 0.3 | A | C |
| 7-2 (Inv.) | Ammonium thiosulfate | 2500 | B-9 | 70 | 0.5 | A | B |
| 7-3 (Inv.) | Ammonium thiosulfate | 2500 | B-9 | 70 | 1.0 | A | A |
| 7-4 (Inv.) | Ammonium thiosulfate | 2500 | B-9 | 70 | 2.0 | A | A |
| 7-5 (Inv.) | Ammonium thiosulfate | 2500 | B-9 | 70 | 3.0 | A | A |
| 7-6 (Inv.) | Ammonium thiosulfate | 2500 | B-9 | 70 | 4.0 | A | A |
| 7-7 (Inv.) | Ammonium thiosulfate | 2500 | B-9 | 70 | 5.0 | B | A |
| 7-8 (Inv.) | Ammonium thiosulfate | 2500 | B-9 | 70 | 6.0 | C | A |
| 7-9 (Inv.) | Ammonium thiosulfate | 2500 | B-11 | 70 | 0.3 | A | C |
| 7-10 (Inv.) | Ammonium thiosulfate | 2500 | B-11 | 70 | 0.5 | A | B |
| 7-11 (Inv.) | Ammonium | 2500 | B-11 | 70 | 1.0 | A | A |

TABLE 7-continued

| Experiment Nos. | Fixing Agent | (g) | Additive | (g) | Weight Loss on Drying at 80° C. | Lubricity | Vibration Test |
|---|---|---|---|---|---|---|---|
| | thiosulfate | | | | | | |
| 7-12 (Inv.) | Ammonium thiosulfate | 2500 | B-11 | 70 | 2.0 | A | A |
| 7-13 (Inv.) | Ammonium thiosulfate | 2500 | B-11 | 70 | 3.0 | A | A |
| 7-14 (Inv.) | Ammonium thiosulfate | 2500 | B-11 | 70 | 4.0 | A | A |
| 7-15 (Inv.) | Ammonium thiosulfate | 2500 | B-11 | 70 | 5.0 | B | A |
| 7-16 (Inv.) | Ammonium thiosulfate | 2500 | B-11 | 70 | 6.0 | C | A |
| 7-17 (Comp.) | Ammonium thiosulfate | 2500 | — | | 2.0 | D | D |
| 7-18 (Comp.) | Ammonium thiosulfate | 2500 | PVA | 70 | 2.0 | C | D |
| 7-19 (Inv.) | Potassium thiocyanate | 2500 | B-9 | 70 | 2.0 | A | A |
| 7-20 (Inv.) | Potassium thiocyanate | 2500 | B-11 | 70 | 2.0 | A | A |
| 7-21 (Inv.) | Sodium thiosulfate | 2000 | B-4 | 70 | 2.0 | B | B |

As is apparent from Table 7, the inventive samples, which weight loss at 80° C. is 0.5 to 5.0% by weight, show improved results in lubricity and reduction of powder production.

What is claimed is:

1. A solid processing composition for providing fixer or bleach-fixer of a silver halide photographic light-sensitive material, wherein the composition comprises a sugar alcohol and 10 to 99.5% by weight of one of a thiosulfate salt and a thiocyanate salt, said sugar alcohol mixed throughout said composition.

2. The solid processing composition of claim 1, wherein the composition comprises said sugar alcohol in an amount of 0.5 to 20 % by weight.

3. The solid processing composition of claim 1, wherein the composition has an ammonmum ion content not more than 90 mol % based on the total cation content.

4. The solid processing composition of claim 1, wherein the composition has an ammonmum ion content not more than 60 mol % based on the total cation content.

5. The solid processing composition of claim 1, wherein the composition is in a tablet form.

6. The solid processing composition of claim 5, wherein the weight loss of the composition on drying at 80° C. for 20 minutes is 0.5 to 5.0 % by weight.

7. A solid processing composition for providing fixer or bleach-fixer of a silver halide photographic light-sensitive material, wherein the composition is in a granule form and comprises a sugar alcohol and one of a thiosulfate salt and a thiocyanate salt, said sugar alcohol mixed throughout said composition.

8. The solid processing composition of claim 7, wherein the granules have an average particle diameter of 100 to 2000 μm and not less than 50% of the granules has an particle diameter falling within a deviation of ±200 to 250 μm.

9. The solid processing composition of claim 8, wherein the weight loss of the composition on drying at 80° C. for 20 minutes is 0.5 to 5.0 % by weight.

* * * * *